US009732570B2

(12) United States Patent
Wang et al.

(10) Patent No.: US 9,732,570 B2
(45) Date of Patent: Aug. 15, 2017

(54) APPARATUS FOR TRIPPING OIL PIPE AND SYSTEM FOR AUTOMATIC WELL WORKOVER

(71) Applicants: China Petroleum & Chemical Corporation, Beijing (CN); Research Institute of Petroleum Engineering, Shengli Oil Field, SINOPEC, Dongying, Shandong (CN)

(72) Inventors: Minxuan Wang, Shandong (CN); Guangqi Gao, Shandong (CN); Lei Zhang, Shandong (CN); Huihui Song, Shandong (CN); Zeng Fu, Shandong (CN); Hui Zhang, Shandong (CN); Zhengquan Cheng, Shandong (CN); Bin Wei, Shandong (CN); Xiliang Li, Shandong (CN); Huawen Shu, Shandong (CN); Qiuhan Su, Shandong (CN); Qianwen Tang, Shandong (CN)

(73) Assignees: CHINA PETROLEUM & CHEMICAL CORPORATION, Beijing (CN); RESEARCH INSTITUTE OF PETROLEUM ENGINEERING, SHENGLI OIL FIELD, SINOPEC, Dongying, Shandong (CN)

( * ) Notice: Subject to any disclaimer, the term of this patent is extended or adjusted under 35 U.S.C. 154(b) by 254 days.

(21) Appl. No.: 14/593,618

(22) Filed: Jan. 9, 2015

(65) Prior Publication Data

US 2015/0197997 A1 Jul. 16, 2015

(30) Foreign Application Priority Data

Jan. 13, 2014 (CN) ..... 2014 1 0013831

(51) Int. Cl.
*E21B 19/20* (2006.01)
*E21B 19/06* (2006.01)
(Continued)

(52) U.S. Cl.
CPC ..... *E21B 19/20* (2013.01); *E21B 19/04* (2013.01); *E21B 19/06* (2013.01); *E21B 19/07* (2013.01); *E21B 19/16* (2013.01)

(58) Field of Classification Search
CPC ..... E21B 19/16; E21B 19/20; E21B 19/06; E21B 19/07; E21B 19/04
See application file for complete search history.

(56) References Cited

U.S. PATENT DOCUMENTS 4,591,007 A * 5/1986 Shaginian ..... E21B 19/15 166/77.53
5,711,382 A * 1/1998 Hansen ..... E21B 19/20 175/52

FOREIGN PATENT DOCUMENTS

CN 101429855 A 5/2009
CN 201963221 U 9/2011
(Continued)

*Primary Examiner* — Yong-Suk (Philip) Ro
(74) *Attorney, Agent, or Firm* — Novick, Kim & Lee, PLLC; Allen Xue

(57) ABSTRACT

An apparatus for tripping oil pipe and a system for automatic well workover comprises an elevator transfer device for transferring an elevator connected with an oil pipe, the elevator transfer device being structured for enabling continuous, automatic tripping operations of the oil pipe. The elevator transfer device comprises a lifting assembly used for lifting and releasing an oil pipe engaged with the elevator, and an elevator transport assembly used for transferring an elevator at a wellhead and/or an elevator on the lifting assembly. The apparatus for tripping oil pipe can lower the labor intensity and improve operation safety.

13 Claims, 9 Drawing Sheets

(51) Int. Cl.

| | |
|---|---|
| ***E21B 19/16*** | (2006.01) |
| ***E21B 19/04*** | (2006.01) |
| ***E21B 19/07*** | (2006.01) |

(56) References Cited

FOREIGN PATENT DOCUMENTS

| | | | |
|---|---|---|---|
| CN | 202249834 | U | 5/2012 |
| CN | 102733764 | A | 10/2012 |
| CN | 102889061 | A | 1/2013 |
| CN | 103352664 | A | 10/2013 |
| CN | 203756073 | U | 8/2014 |
| RU | 2444608 | C2 | 10/2012 |

* cited by examiner

APPARATUS FOR TRIPPING OIL PIPE AND SYSTEM FOR AUTOMATIC WELL WORKOVER

CROSS REFERENCE TO RELATED APPLICATION

The present application claims benefit of Chinese application CN 201410013831.2, entitled "Workover System Unattended at the Wellhead and Technology Thereof" and filed on Jan. 13, 2014, which is incorporated herein by reference.

TECHNICAL FIELD

The present disclosure relates to the technical field of well workover in the oil industry, and in particular, to an apparatus for tripping oil pipe which can be operated unattendedly at the wellhead, and a system for automatic well workover comprising said apparatus.

TECHNICAL BACKGROUND

Well workover is an important step in oilfield production, and has been a labour intensive industry over the years. At present, traditional equipment, which is used in most oilfields, generally requires at least three workers to operate collaboratively. In operation, at least one worker operates a drifting machine or a workover rig to trip an oil pipe, and at least two other workers lift, and attach or detach an elevator at the wellhead. Especially when conducting a minor workover to the wellhead, the workers suffer from hostile working environment, high labour intensity, as well as potential safety hazard during operation.

SUMMARY OF THE INVENTION

The technical problem to be solved by the present disclosure is to provide an apparatus for tripping an oil pipe, which can reduce the labour intensity and improve operation safety.

The technical solution of the present disclosure is to provide an apparatus for tripping oil pipe, comprising an elevator transfer device for transferring an elevator connected with an oil pipe, the elevator transfer device being structured for enabling continuous, automatic tripping operations of the oil pipe.

As compared with the prior art, the present disclosure has the following advantages. According to the present disclosure, the oil pipe can be automatically transferred at the wellhead through the elevator transfer device, thus it is unnecessary for multiple workers to cooperate in order to realize continuous tripping operations of the oil pipe, thereby reducing the labour intensity and enabling continuous, automatic tripping operations of the oil pipe at the wellhead. In this manner, the working efficiency can be improved, the probability for accidents can also be significantly reduced, and the working safety can be higher.

It should be noted that the tripping operations, i.e., tripping out and tripping in operations, of an oil pipe in well workover can generally be divided into a broad sense and a narrow sense. The tripping out operation of an oil pipe in a broad sense includes pulling the oil pipe out of the wellhead and transporting the oil pipe to a target location on the ground, for example, transporting the oil pipe tripped out and putting it on an oil pipe rack. The tripping in operation of an oil pipe in a broad sense includes taking an oil pipe from the oil pipe rack on the ground, transporting the oil pipe to a wellhead, and tripping the oil pipe into the well. However, the tripping out operation of an oil pipe in a narrow sense only refers to pulling the oil pipe out of the well, and the tripping in operation of an oil pipe only refers to running the oil pipe above the wellhead into the well. Unless otherwise specified, the tripping operations of the oil pipe in the present disclosure are of narrow sense.

In an embodiment, the elevator transfer device comprises a lifting assembly used for lifting and releasing an oil pipe engaged with the elevator, and an elevator transport assembly used for transferring an elevator at a wellhead and/or an elevator on the lifting assembly. A cycle operation between an elevator on the lifting assembly and an elevator connected to an oil pipe at the wellhead can be realized through the elevator transport assembly.

In an embodiment, two connection points are formed by the trajectory of the elevator transport assembly and that of the lifting assembly, and the elevator transport assembly and the lifting assembly can operate simultaneously. In the accompanying drawings and the embodiments, an upper connection point is marked as A and a lower connection point is marked as B. Because the lifting assembly and the elevator transport assembly can operate simultaneously, it is unnecessary for them to wait for each other, and thus the operation time can be reduced and the operation efficiency can be improved.

In a preferred embodiment, the lifting assembly and the elevator transport assembly can perform a direct handover of an empty elevator at an upper connection point of the two connection points therebetween. It should be readily understood that the upper connection point keeps a safe distance from the wellhead, so that when the elevator is handed over between the elevator transport assembly and the lifting assembly, collision between the elevator and any other components or devices disposed adjacent to the wellhead can be avoided to the largest extent, thereby improving the operation safety.

Preferably, at a preset location below a lower connection point of the two connection points, one of the lifting assembly and the elevator transport assembly is used for picking up the elevator while the other is used for releasing the elevator. The handover of the elevator between the elevator transport assembly and the lifting assembly does not occur directly at the preset location below the lower connection point. Instead, the elevator is picked up from or placed on a platform, which is used for placing or supporting the elevator, by either the elevator transport assembly or the lifting assembly. In addition, the elevator transport assembly is configured to transfer empty elevator only. In the context, the term "empty elevator" refers to an elevator to which no oil pipe is connected. The transportation of an empty elevator means to transport an idle elevator. Because the elevator transport assembly rotates along an approximately circular path, the transportation of an empty elevator lowers the requirements on the bearing capacity of the elevator transport assembly, rendering the transportation of the elevator safer.

In a preferred embodiment, the elevator transport assembly comprises a rotation mechanism for carrying the elevator for rotation along a circular path, and a detent mechanism for loading/unloading as well as moving an elevator adjacent to the wellhead. In a preferred embodiment, during the tripping operations of the oil pipe, the angle of rotation of the rotation mechanism is larger than 180° and smaller than 360°. That is, the movement of the rotation mechanism is not around an entire circumference, such that the rotation mechanism can avoid crashing into the oil pipe during rotation. In the meantime, the rotation mechanism and the lifting assembly can both operate at the same time, and thus the operation time can be reduced and the operation efficiency can be improved. Specifically, the rotation mechanism will not rotate into a relatively small area between the upper connection point and the lower connection point in which it can easily crash into the lifting assembly. By keeping the rotation mechanism away from this area, it is unnecessary for the rotation mechanism and the lifting assembly to wait for each other to finish their operations in order to avoid collision in this area. Therefore, the rotation mechanism and the lifting assembly can operate simultaneously without interfering with each other.

In an embodiment, when tripping out the oil pipe, the lifting assembly carries an empty elevator and descends to the upper connection point, and the rotation mechanism takes down the empty elevator from the lifting assembly and rotates therewith. Then, the lifting assembly continues to descend to the preset location below the lower connection point, where an elevator carrying an oil pipe is mounted to the lifting assembly under the assistance of the detent mechanism, and then the lifting assembly ascends with the oil pipe. Subsequently, the rotation mechanism carries the empty elevator and rotates to a preset location thereof adjacent to the wellhead and releases the empty elevator under the assistance of the detent mechanism, the empty elevator being continued to move to the wellhead and connect to an oil pipe to be tripped out under the action of the detent mechanism, so as to be ready for tripping operations of a next oil pipe.

It should be understood that in order to keep the lifting assembly and the rotation mechanism from interfering with each other, the preset location below the lower connection point B of the lifting assembly is arranged to be different from that of the rotation mechanism. The preset location below the lower connection point of the lifting assembly refers to a location H at an axis of the wellhead. The preset location below the lower connection point of the rotation mechanism refers to a position on the circular trajectory thereof that has not yet reached the lower connection point B, such as a position F or a position E as shown in the drawings. The preset locations and the distance therebetween are arranged as such that the rotation mechanism will not crash into the oil pipe and the lifting assembly during a circular movement thereof. With such structure, the lifting assembly and the rotation mechanism can work independently during most of the time, thereby improving the working efficiency. Furthermore, the cooperation between the lifting assembly and the rotation mechanism guarantees that after an oil pipe is tripped out, there is still an elevator available to a next oil pipe to be tripped out. In this case, the lifting assembly carries the empty elevator and descends, in order to perform a tripping operation of the next oil pipe. In this way, continuous tripping operations of the oil pipe can be achieved.

In an embodiment, when tripping in the oil pipe, the empty elevator released at the wellhead moves and engages with the rotation mechanism under the action of the detent mechanism, and rotates towards the upper connection point under the action of the rotation mechanism. When the rotation mechanism carries the elevator to rotate towards the upper connection point, the lifting assembly carries the elevator to which an oil pipe is connected to descend to the wellhead and releases the elevator under the assistance of the detent mechanism, and then ascends to the upper connection point. The rotation mechanism hands the empty elevator over to the lifting assembly at the upper connection point, and the lifting assembly carries the empty elevator and continues to ascend to a target location, so as to be ready for tripping operations of a next oil pipe. In this case, a continuous tripping operation of the oil pipe can be realized.

In an embodiment, the detent mechanism comprises:

- a fixed plate disposed at the wellhead for supporting the elevator,
- a moving block flexibly arranged on the fixed plate, which enables the elevator to move back and forth adjacent to the wellhead,
- a movable connecting plate which is hinged with one end of the fixed plate and can move downwards,
- an arm for supporting the pick-up/put-down of the elevator connected with the movable connecting plate, and
- a driver member for driving the movable connecting plate and the arm for supporting the pick-up/put-down of the elevator.

The moving block can push an elevator adjacent to the wellhead into the range of movement of the rotation mechanism, or take down an elevator from the rotation mechanism and push it to the wellhead where it is connected to an oil pipe. While the movable connecting plate is rotating downwards, an elevator at the wellhead can be connected to the rotation mechanism and rotate therewith up towards the upper connection point smoothly, without contacting the movable connecting plate. When the movable connecting plate rotates upwards to be flush with the fixed plate, it can support the elevator connected with the rotation mechanism and enable the elevator to move smoothly towards the wellhead onto the fixed plate under the action of the moving block, so that the elevator can be connected to an oil pipe at the wellhead.

In addition, the arm for supporting the pick-up/put-down of the elevator is engaged with the movable connecting plate. When tripping in an oil pipe, the movable connecting plate rotates downwards after the rotation mechanism is connected with an elevator. At the same time, the arm for supporting the pick-up/put-down of the elevator supporting an empty elevator also rotates downwards and releases the elevator. The elevator rotates with the rotation mechanism towards the upper connection point, where it is transferred to the lifting assembly and moves upwards therewith, so as to be ready for tripping in operations of a next oil pipe. When tripping out an oil pipe, the rotation mechanism delivers an empty elevator to a trigger point of the movable connecting plate, where the movable connecting plate starts to rotate upwards, and the movable connecting plate rotates upwards to be flush with the fixed plate. The arm for supporting the pick-up/put-down of the elevator also rotates upwards to support the elevator. The elevator moves towards the wellhead under the pulling force of the moving block and connects with an oil pipe adjacent to the wellhead, so as to be ready for tripping out operations of a next oil pipe.

In an embodiment, the driver member of the detent mechanism is in a form of a drive cam, which is connected with the movable connecting plate and the arm for supporting the pick-up/put-down of the elevator. The rotation of the cam drives the movable connecting plate and the arm for supporting the pick-up/put-down of the elevator to rotate therewith. In addition, the cam is located below the movable connecting plate, and supports the movable connecting plate when it is flush with the fixed plate.

In a preferred embodiment, the moving block is driven by a hydraulic cylinder and is disposed at one side of an axis of the wellhead opposite to the rotation mechanism, and the arm for supporting the pick-up/put-down of the elevator and the rotation mechanism are located at the other side of the axis of the wellhead. With such structure, the elevator can move along a straight path adjacent to the wellhead under the action of the moving block when it is placed on the fixed plate or the movable connecting plate adjacent to the wellhead.

In an embodiment, the rotation mechanism comprises:

a rotation supporting structure, a rotation shaft rotatably connected to the rotation supporting structure, and a rotating arm connected to the elevator, which is fixedly connected to the rotation shaft and rotates therewith.

In an embodiment, the elevator comprises an n-shaped ring connected to a lifting hook of the lifting assembly, and an oil pipe connecting base provided on an opening of the n-shaped ring. The n-shaped ring is in flexible connection with the oil pipe connecting base. A valve for connecting to an oil pipe is disposed on the oil pipe connecting base. When the valve is opened, a clamp which is connected to an oil pipe is loosened; and when the valve is closed, the oil pipe is tightly connected to the elevator. In addition, two side walls of the n-shaped ring are provided with pick-up/put-down projections engaged with the elevator transport assembly. Here, the flexible connection between the n-shaped ring and the oil pipe connecting base means that the n-shaped ring can rotate for a certain angle relative to a vertical axis of the oil pipe connecting base, for example 10°-50°. Preferably, this angle is 15°-35°.

In a preferred embodiment, two rotating arms symmetrically arranged relative to the axis of the wellhead are provided, an inner side of each of the rotating arms being provided with a connecting block engaged with the pick-up/put-down projection on the outside of the n-shaped ring of the elevator, wherein the two relatively arranged connecting blocks engage and interlock with each other during the transfer of the elevator, and unlock from each other when the elevator is delivered to the target location. The two rotating arms are respectively connected with the two pick-up/put-down projections on the outside of the n-shaped ring. The pick-up/put-down projections can move relative to the connecting block. During transportation of the elevator, the connecting block cannot move laterally or release the elevator, so that the safety of the elevator during transportation can be guaranteed.

In a preferred embodiment, the angle of rotation of the rotation shaft is larger than 270° and smaller than 345°. The angle of rotation of the rotation shaft is controlled by a driving motor connected therewith. Generally, a servo drive motor can be used to accurately control the angle of rotation of the rotation shaft.

In an embodiment, the lifting assembly comprises a lifting hook connected to the elevator and a locking mechanism arranged on the lifting hook for locking the elevator, wherein the locking mechanism locks up during the transfer of the elevator, and unlocks when the elevator is delivered to the target location. By locking up the lifting hook through the locking mechanism, it can be guaranteed that the elevator will not slip off the lifting hook during transportation due to vibration, thereby ensuring the operation safety.

In a preferred embodiment, the locking mechanism comprises:

a locking block engaged and interlocked with a groove arranged on the other side relative to an inlet of the lifting hook, which is disposed at a tip of the lifting hook adjacent to the inlet thereof, a rack disposed on a sliding rail on the lifting hook and fixedly connected with the locking block, a worm gear connected to the lifting hook and engaged with the rack, and a motor connected to the lifting hook for driving the worm gear.

The motor drives the worm gear to rotate, so that the rack slips off the sliding rail and engages with a groove arranged on the other side away from the tip of the lifting hook to lock up the elevator. If it is necessary to unlock the elevator, the motor counter-rotates so that the rack can be retracted, thereby releasing the elevator from the lifting hook.

The present disclosure further relates to a system for automatic well workover, comprising:

a make-up/break-out device for connecting an oil pipe joint to an oil pipe and for demounting the oil pipe joint connected with the oil pipe, an oil pipe centralizer device for centralizing an oil pipe, an oil pipe transport and hoist device for transporting and hoisting an oil pipe, the apparatus for tripping an oil pipe as mentioned above, and a controller electrically connected to the make-up/break-out device, the oil pipe centralizer device, the apparatus for tripping oil pipe, and the oil pipe transport and hoist device. The system for automatic well workover can realize automatic operations. And by controlling the devices through a controller, an unattended and continuous operation of wellhead workover can be realized.

BRIEF DESCRIPTION OF THE ACCOMPANYING DRAWINGS

FIG. 1 schematically shows a structure of an apparatus for tripping an oil pipe at an initial stage of a tripping out operation of an oil pipe.

FIG. 2 schematically shows a structure of an apparatus for tripping oil pipe at an initial stage of a tripping in operation of an oil pipe.

Figure 4:
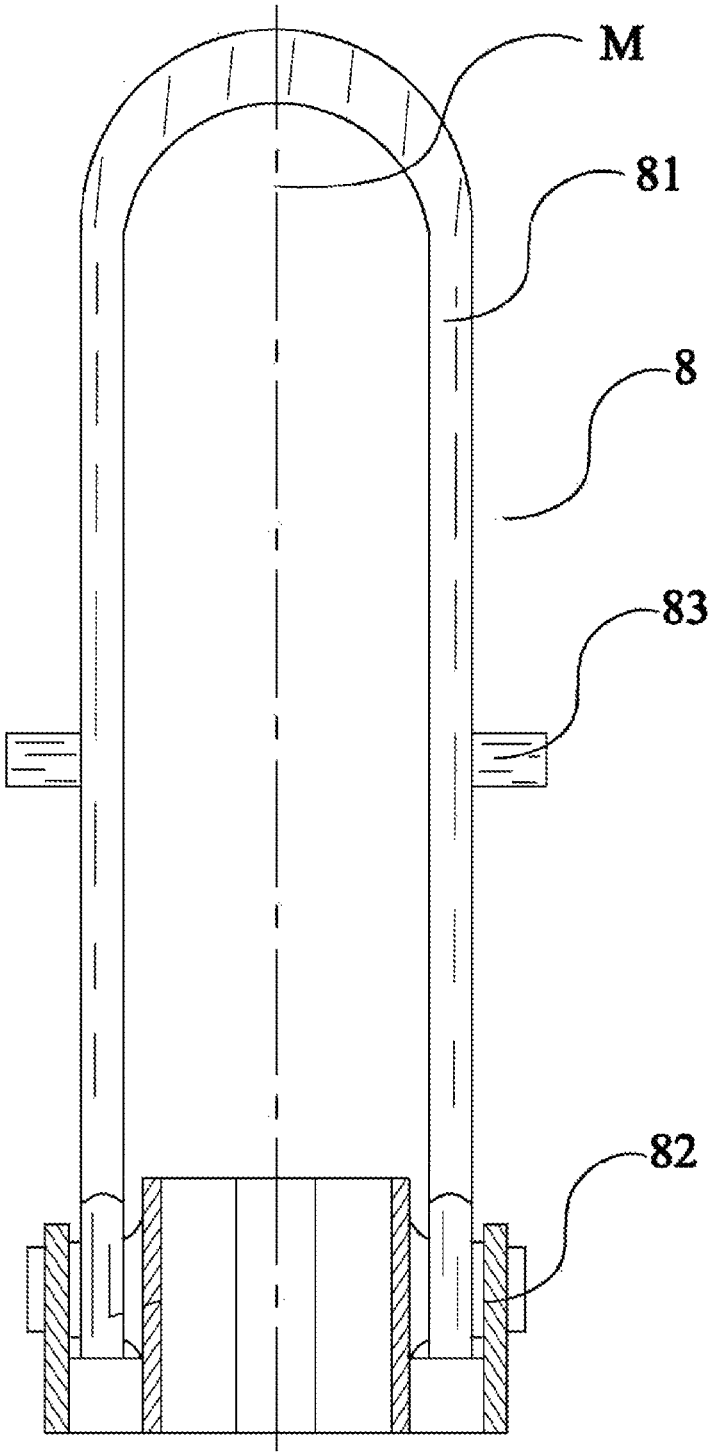
FIG. 4 shows an example an elevator of FIG. 1.
Figure 5:
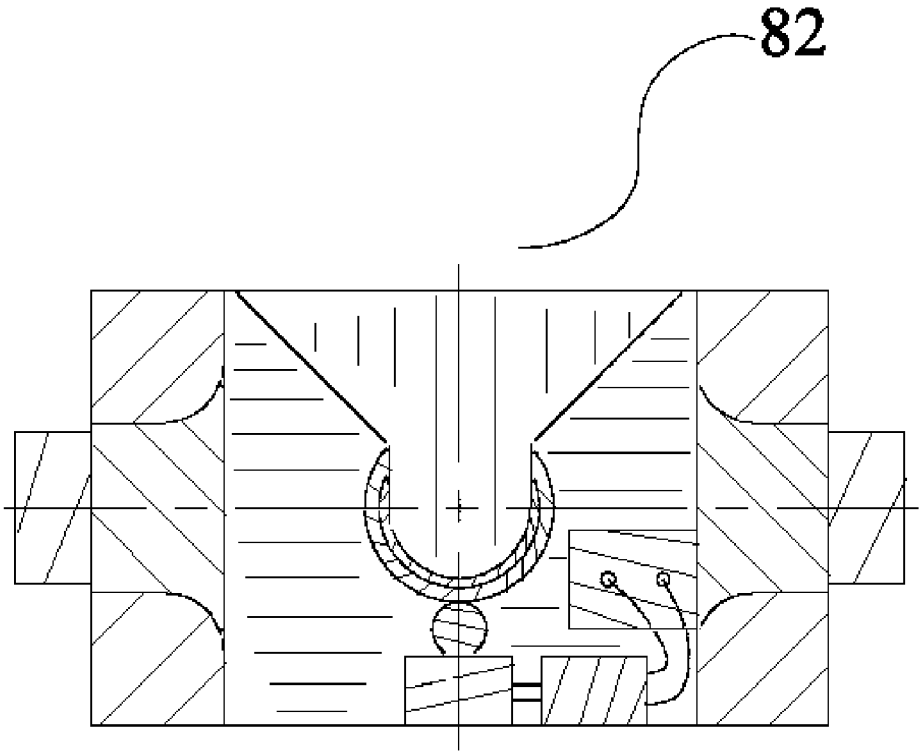

FIG. 5 schematically shows a sectional plan view of an oil pipe connecting base of the elevator according to FIG. 4.

Figure 1:
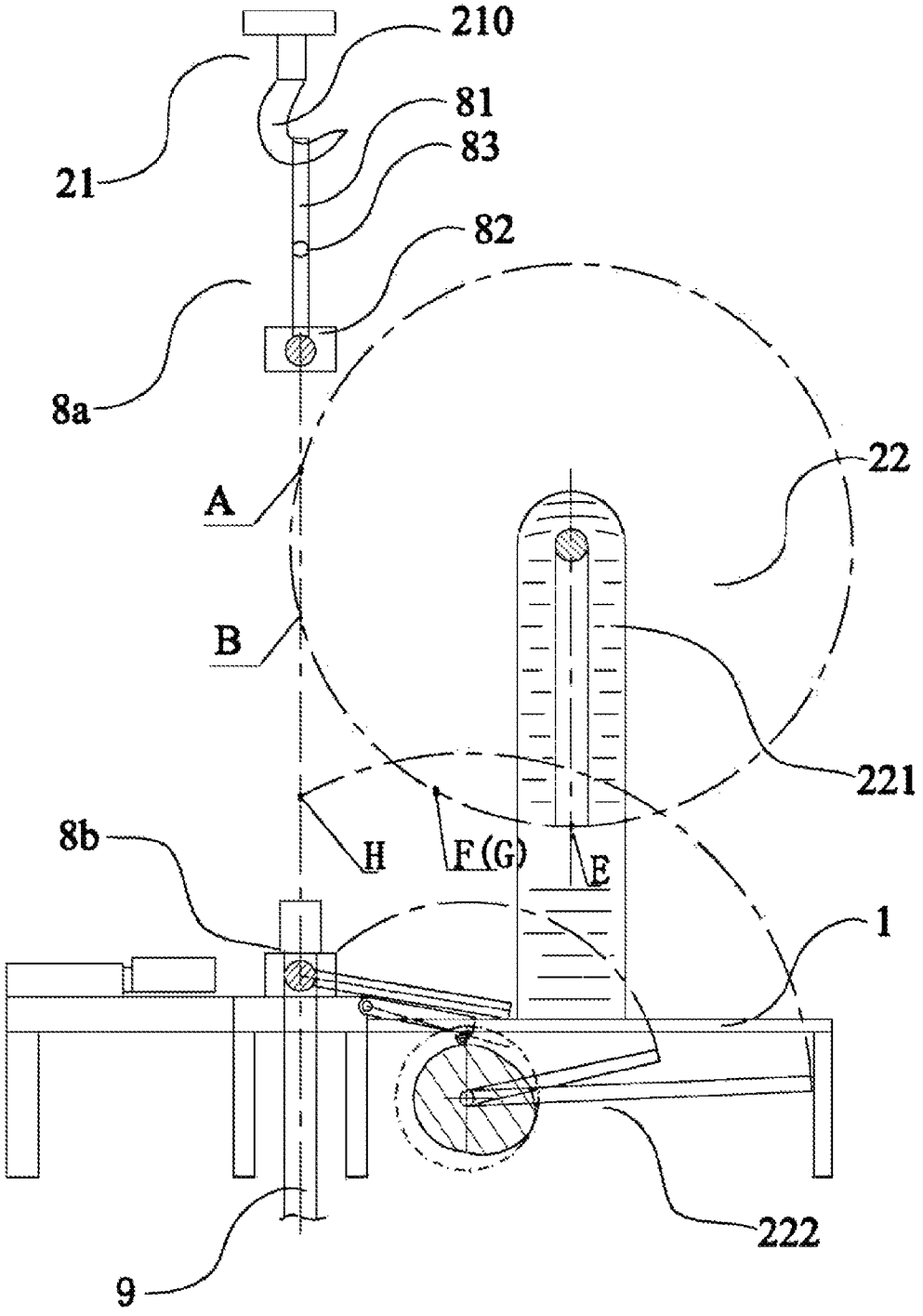
Figure 6:
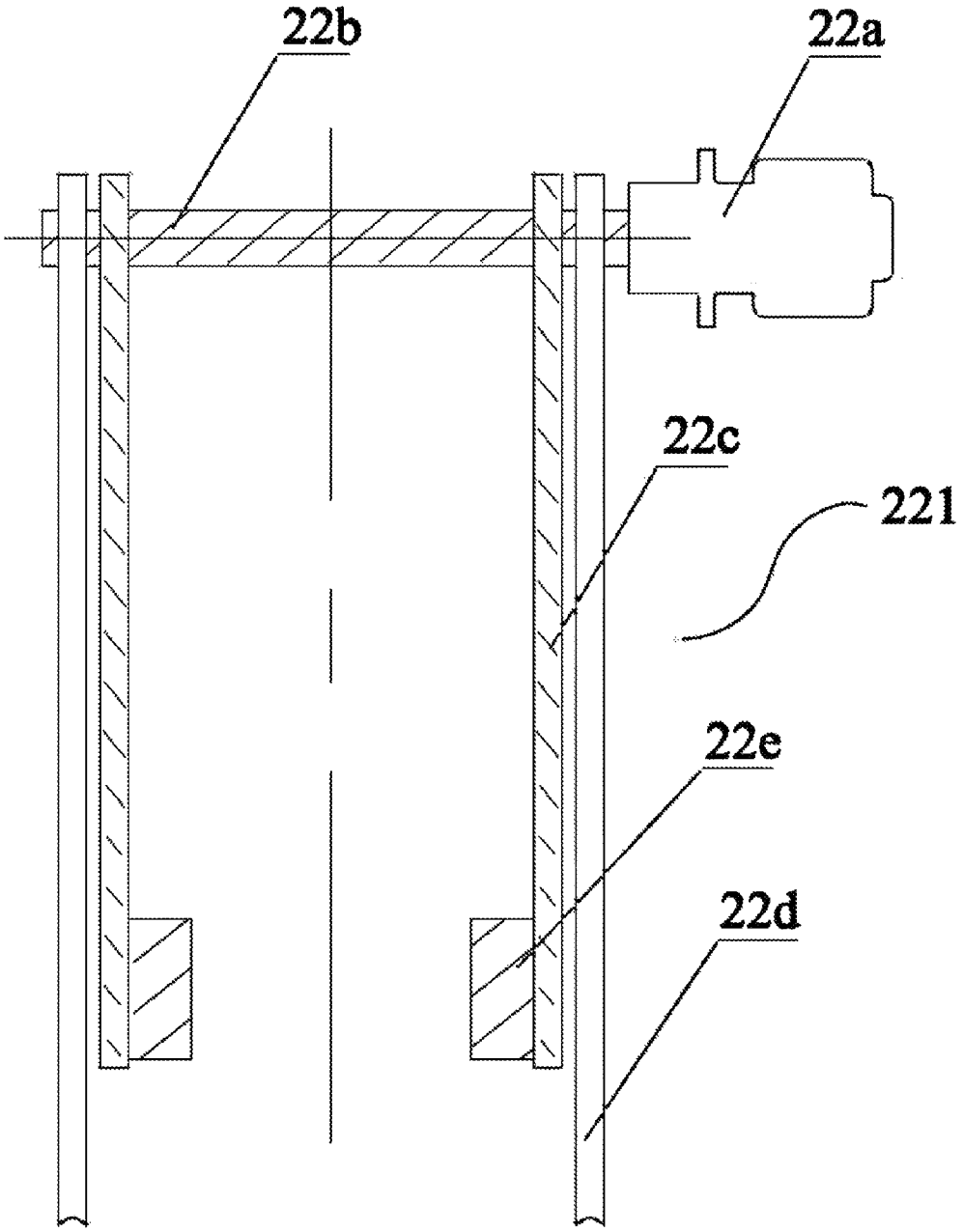

FIG. 6 shows an example of a rotation mechanism of an elevator transfer device according to FIG. 1.

Figure 7:
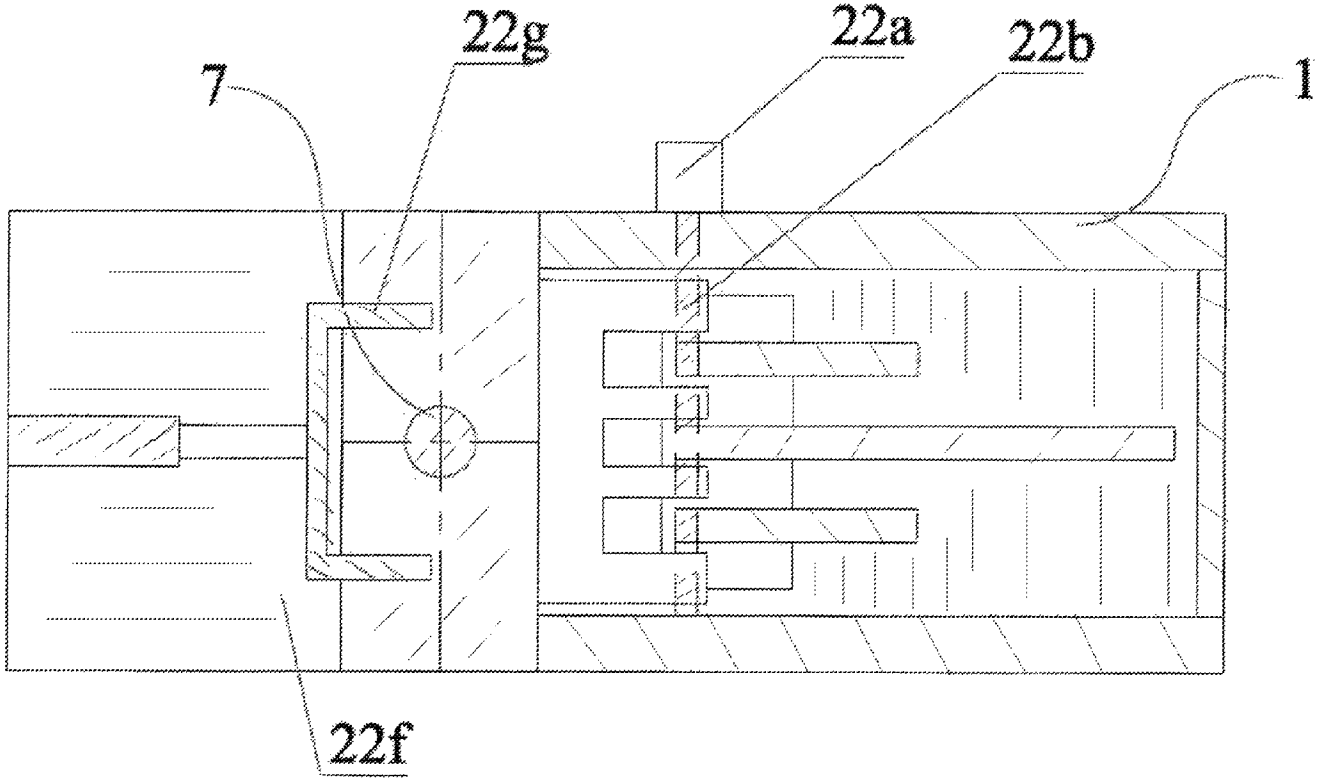

FIG. 7 schematically shows a plan view of an example of a detent mechanism of the elevator transfer device according to FIG. 1.

Figure 8:
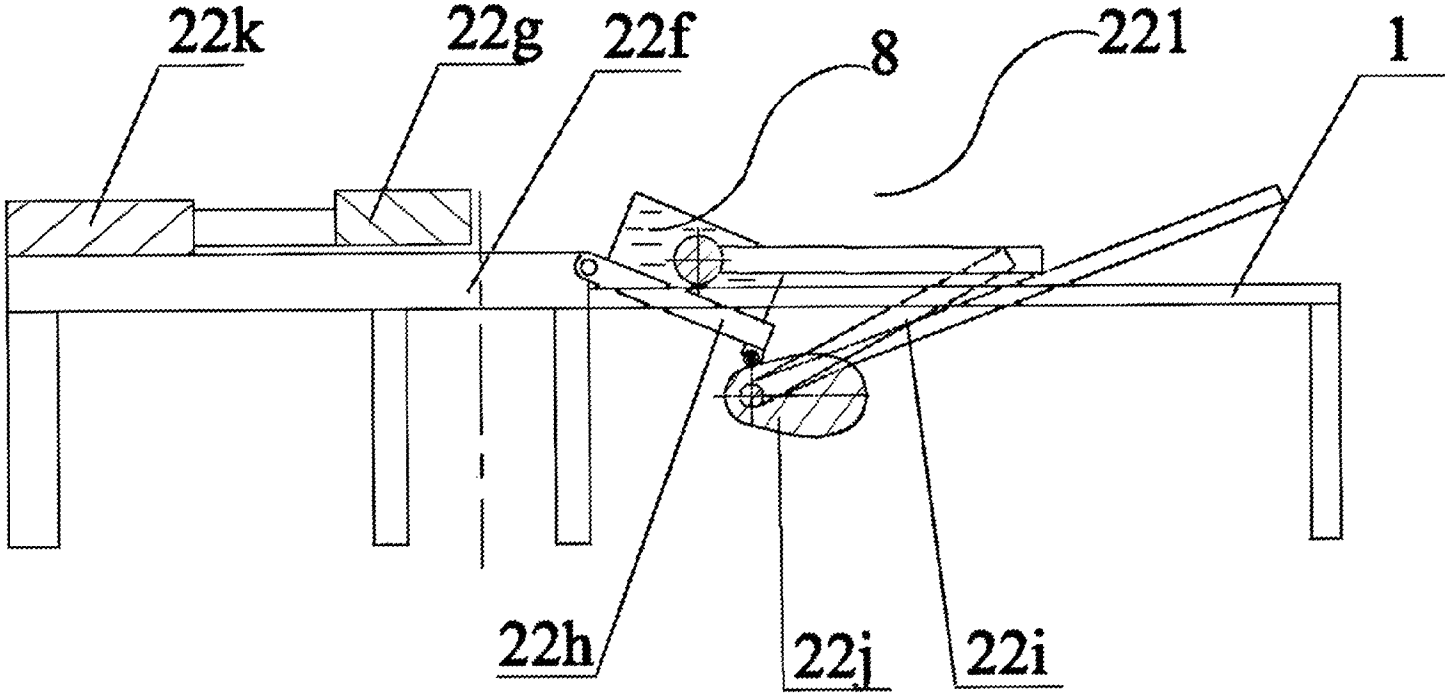

FIG. 8 shows a front view of FIG. 7.

Figure 9:
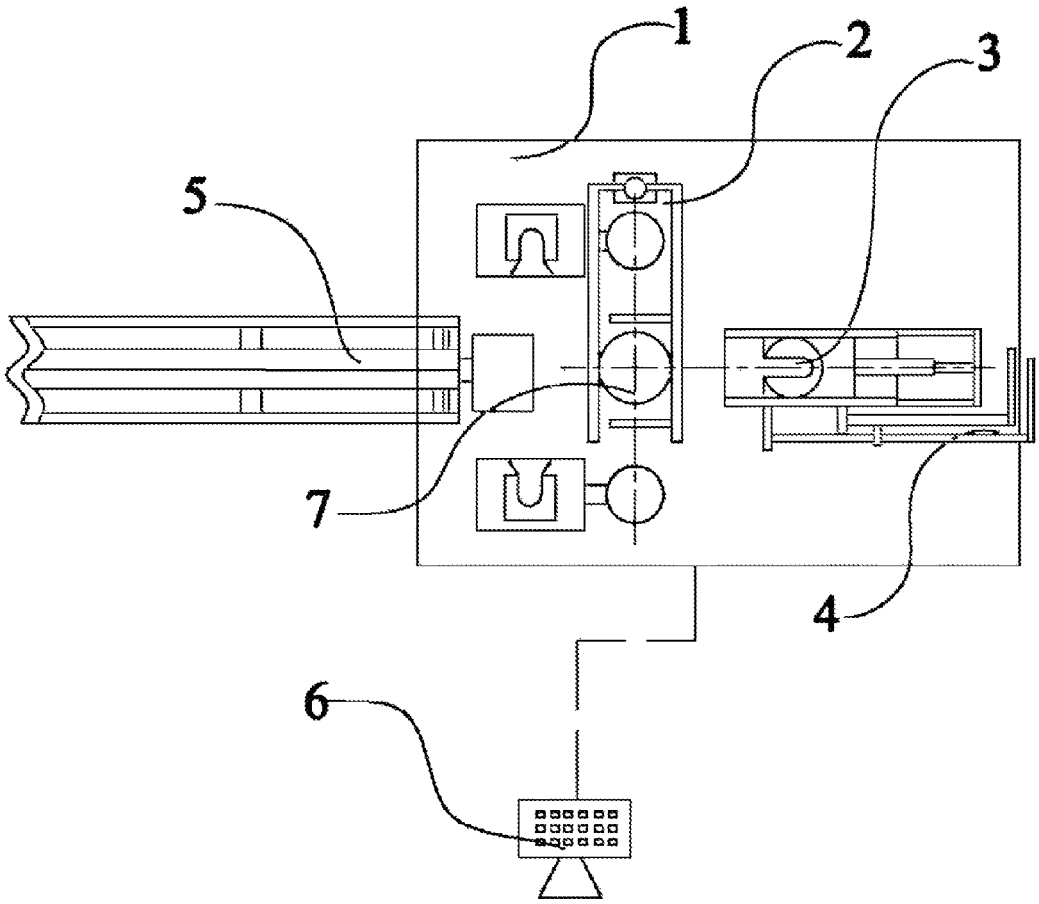

FIG. 9 shows an example of a system for automatic well workover comprising the apparatus for tripping an oil pipe according to the present disclosure.

DETAILED DESCRIPTION OF THE EMBODIMENTS

The present disclosure will be further explained in view of the accompanying drawings and the examples.

FIG. 9 shows an example of a system for automatic well workover according to the present disclosure. In the example, the system for well workover mainly comprises an operation platform 1, an elevator transfer device 2, a make-up/break-out device 3, an oil pipe centralizer device 4, an oil pipe transport and hoist device 5, and a controller 6. The operation platform 1 is disposed at a wellhead 7. The make-up/break-out device 3 is used for making up or breaking out an oil pipe joint. The oil pipe transport and hoist device 5 is used for picking up an oil pipe 9 from a target location before the tripping in operation of the oil pipe, and hoisting the oil pipe 9 transported for facilitating the tripping operation of the oil pipe 9, or used for laying down an oil pipe 9 which is tripped out of the wellhead 7 and delivering it to the target location. Moreover, the oil pipe centralizer device 4 is connected to the operation platform 1, and cooperates with the oil pipe transport and hoist device 5. In particular, the hoisted oil pipe 9 is centralized by the oil pipe centralizer device 4 before it is tripped in, so that the oil pipe joint can be successfully made up to the oil pipe 9. The elevator transfer device 2 is mainly used in the tripping in and tripping out operations. The oil pipe 9 is tripped into a well or tripped out of a well through the wellhead 7 by means of the transfer of an elevator 8 connected with the oil pipe 9.

Figure 2:
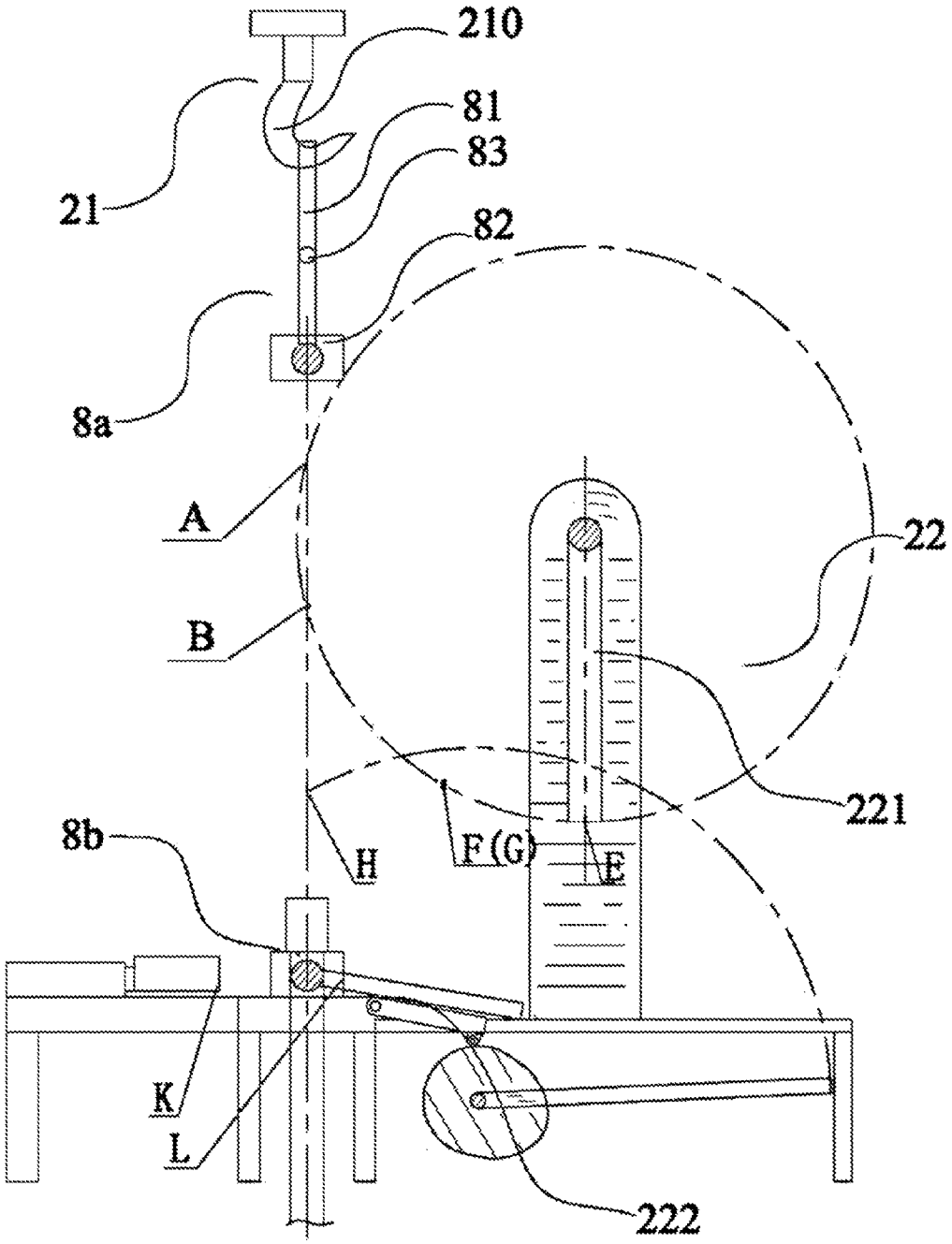
Figure 3:
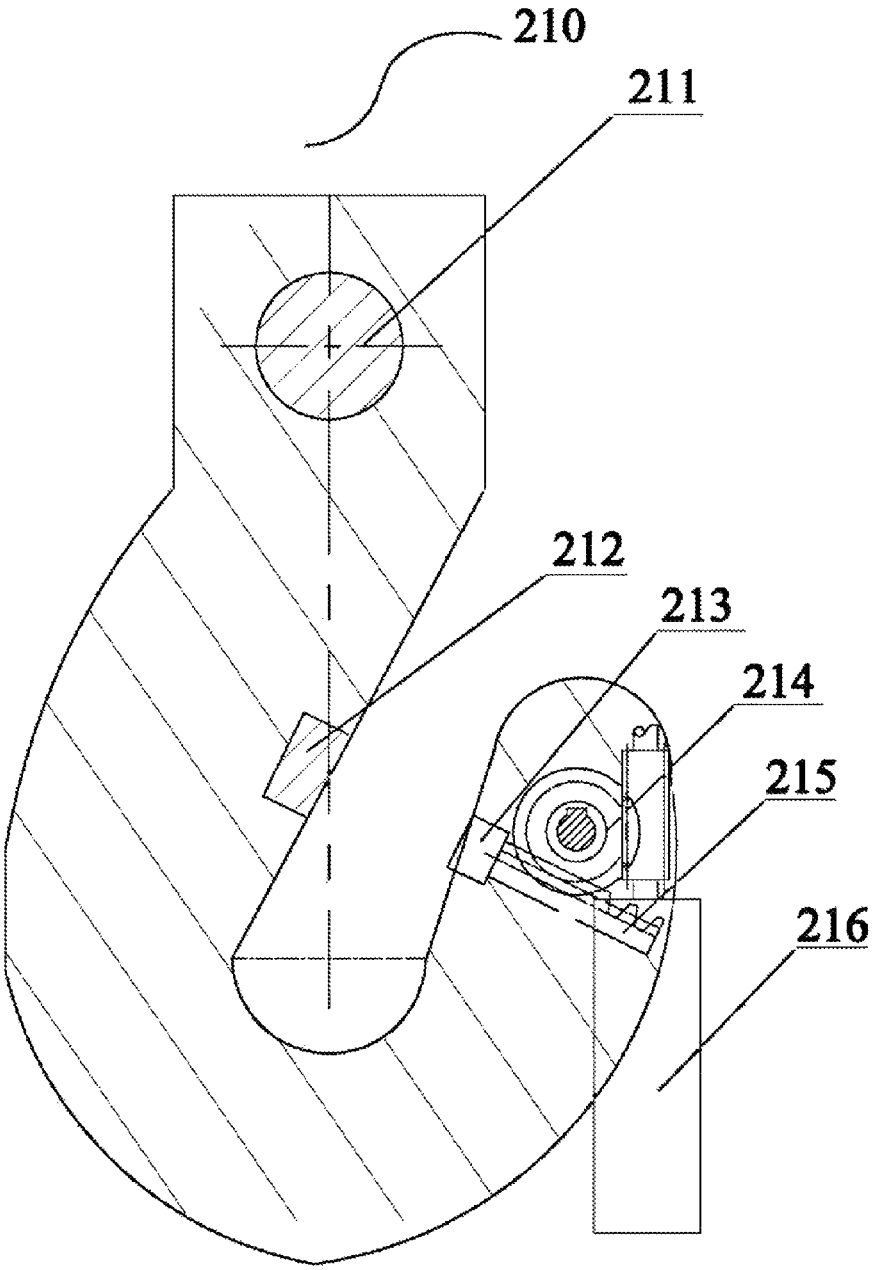
FIG. 3 shows an example of a lifting hook of FIG. 1 when it has not been locked up.

FIG. 1 and FIG. 2 show a specific example of the elevator transfer device 2. In this example, the elevator transfer device 2 mainly comprises a lifting assembly 21 used for lifting and releasing the oil pipe 9 connected to the elevator 8, and an elevator transport assembly 22 used for transferring an elevator 8 at or adjacent to the wellhead 7 and/or an elevator 8 on the lifting assembly 21. The elevator transfer device 2 transfers the oil pipe 9 connected to the elevator 8 to or out of the wellhead 7 through the lifting assembly 21 and the elevator transport assembly 22. In the tripping operations, because two elevators 8*a* and 8*b* with completely the same structure are provided on the elevator transfer device 2, oil pipes 9 can be alternately connected to elevator 8*a* or elevator 8*b*, so that continuous tripping operations of the oil pipes can be realized.

In an example, the lifting assembly 21 generally carries the oil pipe 9 through the elevator 8, and moves upwards or downwards relative to the wellhead 7 along an axis thereof.

In an example, the elevator transport assembly 22 mainly comprises a rotation mechanism 221 and a detent mechanism 222. The rotation mechanism 221 carries the elevator 8 to rotate along a circular path, and the detent mechanism 222 enables an empty elevator 8 to move adjacent to the wellhead 7. Furthermore, the detent mechanism 222 is also used for picking up or putting down the elevator 8 adjacent to the wellhead 7. For example, the rotation mechanism 221 carries an empty elevator 8 and moves to the vicinity of the wellhead 7, and then releases the empty elevator 8 therefrom through the detent mechanism 222. When a lifting hook 210 of the lifting assembly 21 descends to vicinity of the wellhead 7, it is also the detent mechanism 222 that connects the elevator 8, to which an oil pipe 9 is connected, to the lifting hook 210.

In an example as shown in FIG. 1 and FIG. 2, in the tripping in operation or tripping out operation of the oil pipe, the lifting assembly 21 carries the oil pipe 9 to move upwards or downwards linearly along the axis of the wellhead 7, and the rotation mechanism 221 carries the elevator 8 to rotate along a circular path. Two connection points or points of intersection are formed by the trajectory of the rotation mechanism 221 and that of the lifting assembly 21, namely an upper connection point A and a lower connection point B. The rotation mechanism 221 and the lifting hook 210 perform a direct handover of the empty elevator 8 at the upper connection point A. However, at a preset location below the lower connection point B, the rotation mechanism 221 and the lifting hook 210 are not in direct contact with each other. Rather, either of the rotation mechanism 221 and the lifting hook 210 puts the elevator 8 down, and then at a different time point the other picks it up. It should be understood that the preset location below the lower connection point B of the rotation mechanism 221 and that of the lifting hook 210 can be different, such that the rotation mechanism 221 and the lifting hook 210 can operate independently.

In a preferred example, in the tripping operations of the oil pipe, the angle of rotation of the rotation mechanism 221 is larger than 180° and smaller than 360°. Because the rotation of the rotation mechanism 221 is not around an entire circumference, the rotation mechanism 221 can stay away from an area between the upper connection point A and the lower connection point B in which it can easily crash into the oil pipe 9 or the lifting assembly 21, thereby avoiding such crash. In the meantime, the lifting assembly 21 and the rotation mechanism 221 can operate simultaneously, and thus it is unnecessary for them to wait for each other for a long time. As a result, the operation time can be reduced, and the operation efficiency can be significantly improved.

In an example as shown in FIG. 7 and FIG. 8, the detent mechanism 222 mainly comprises a fixed plate 22*f*, a moving block 22*g*, a movable connecting plate 22*h*, an arm 22*i* for supporting the pick-up/put-down of the elevator, and a drive cam 22*j*. The fixed plate 22*f* is disposed on the operation platform 1. The moving block 22*g* is driven by a hydraulic cylinder 22*k*. The movable connecting plate 22*h* is hinged with a tip of an end of the fixed plate 22*f* adjacent to the wellhead 7 at one end, and connected with a roller at the other end thereof. The movable connecting plate 22*h* is rotatably engaged with the drive cam 22*j* through the roller. Two arms 22*i* for supporting the pick-up/put-down of the elevator are coaxially connected with the drive cam 22*j*, such that the rotation of the drive cam 22*j* drives the two arms 22*i* to rotate therewith. The two arms 22*i* act on the elevator 8. The moving block 22*g* can push the elevator 8 adjacent to the wellhead 7 into the range of movement of the rotation mechanism 221, or take down the elevator 8 from the rotation mechanism 221 and push it to the wellhead 7 where it is connected with an oil pipe 9.

Furthermore, the two arms 22*i* for supporting the pick-up/put-down of the elevator can operate in cooperation with the movable connecting plate 22*h*. When tripping in an oil pipe, the movable connecting plate 22*h* rotates downwards after the rotation mechanism 221 is connected with an elevator 8. At the same time, the arms 22*i* supporting the elevator 8 also rotates downwards and then releases the elevator. In this case, the elevator 8 can rotate smoothly with the rotation mechanism 221 towards the upper connection point A, where the empty elevator 8 is transferred from the rotation mechanism 221 to the lifting assembly 21, so as to be ready for tripping operations of a next oil pipe. When tripping out an oil pipe, the rotation mechanism 221 delivers an empty elevator 8 to a trigger point of the movable connecting plate 22*h*, and the movable connecting plate 22*h* rotates upwards until being flush with the fixed plate 22*f*. In the meantime, the arms 22*i* also rotate upwards to the position where they support the elevator 8. The elevator 8 moves towards the wellhead 7 under the pulling force of the moving block 22*g* and connects with an oil pipe 9 adjacent to the wellhead 7, so as to be ready for tripping operations of a next oil pipe.

Still further, in the tripping in operation of the oil pipe, when the lifting hook 210 moves with the oil pipe 9 and the elevator 8 to the preset location and releases the elevator 8, the two arms 22*i* for supporting the pick-up/put-down of the elevator support the elevator 8 released from the lifting hook 210. In the tripping out operation of the oil pipe, when the lifting hook 210 descends to the preset location, the two arms 22*i* push the elevator 8 and enable it to be connected to the lifting hook 210.

In an example as shown in FIG. 4, the elevator 8 mainly comprises an n-shaped ring 81, and an oil pipe connecting base 82 arranged at an opening end of the n-shaped ring 81. FIG. 5 shows a specific structure of the oil pipe connecting base 82. The oil pipe connecting base 82 is provided with a valve. When the valve is opened, the oil pipe connecting base 82 releases the oil pipe 9 connected thereto. The valve is closed after the oil pipe 9 is connected thereto, so that the oil pipe connecting base 82 and the oil pipe 9 can be tightly connected with each other. The n-shaped ring 81 is flexibly or rotatably connected with the oil pipe connecting base 82, i.e., the n-shaped ring 81 can rotate for a certain angle relative to a vertical axis M of the oil pipe connecting base 82. As shown in FIG. 4, the n-shaped ring 81 can rotate inward or outward perpendicular to the sheet of the drawing. In a preferred example, the angle of deflection of the n-shaped ring 81 relative to the vertical axis M of the oil pipe connecting base 82 is 10°-50°. Preferably, the angle of deflection is in a range of 15°-35°. The elevator 8 can be easily connected or mounted to the lifting assembly 21 or easily unloaded from the lifting assembly 21 due to said angle of deflection. Moreover, pick-up/put-down projections 83 are disposed on the central outer surface of the two sides of the n-shaped ring 81.

In an example as shown in FIG. 6, the rotation mechanism 221 mainly comprises a rotation support structure 22*d*, a rotation shaft 22*b*, and a rotating arm 22*c*. The rotation shaft 22*b* is directly driven by a driving motor or hydraulic motor 22*a*, and the angle of rotation of the rotation shaft 22*b* is controlled by the driving motor or hydraulic motor 22*a*. The rotation support structure 22*d* comprises two branching supports fixedly connected to the operation platform 1. The rotation shaft 22*b* passes through the two branching supports of the support structure 22*d*, and is rotatably connected thereto.

In a preferred example as shown in FIG. 6, two rotating arms 22*c* fixedly connected to the rotation shaft 22*b* are disposed between the two branching supports of the rotation support structure 22*d* and symmetrically arranged relative to the axis of the wellhead 7. Connecting blocks 22*e*, which are engaged with the pick-up/put-down projections 83 on the outside of the n-shaped ring 81 of the elevator 8, are disposed opposite to each other on a lower inner side of the rotating arms 22*c*. When the rotating arms 22*c* are connected to the elevator 8, the connecting blocks 22*e* of the two rotating arms 22*c* clamping the pick-up/put-down projections 83 of the elevator 8, and thus the elevator 8 rotates with the rotating arms 22*c* under the action thereof.

In an example, the connecting blocks 22*e* of the two rotating arms 22*c* are connected with the two pick-up/put-down projections 83, thereafter forming an anti-rotational lock against the pick-up/put-down projections 83. Such structure can guarantee a high safety coefficient of the rotation mechanism during the transportation of the elevator 8. After the elevator 8 is delivered to the target location, the anti-rotational lock of the connecting blocks 22*e* against the pick-up/put-down projections 83 is released, so that the rotating arms 22*c* can be separated from the elevator 8 easily. Preferably, the locking and unlocking actions of the connecting blocks 22*e* of the rotating arms 22*c* are controlled by a relay or controller 6 connected therewith, which can be realized by means of conventional control technology, or any known technology capable of controlling such locking and unlocking actions. Thus the control means will not be explained in details herein.

In an example, the lifting assembly 21 is connected with a travelling block of the workover rig through a pin which passes through a pin hole 211 at an upper part of the hook body of the lifting hook 210, thereby achieving the tripping operations of the oil pipe. Since the lifting hook 210 is directly connected with the elevator 8, in order to prevent the elevator 8 from falling off from the lifting hook 210 due to vibration during transportation, a locking mechanism is disposed on a position near the tip of the lifting hook 210 for locking the elevator 8. The locking mechanism can lock up during the transfer of the elevator 8, so as to guarantee a safe transportation thereof. When the elevator 8 is delivered to the target location, such as the upper connection point A or an unloading location adjacent to the wellhead 7, the locking mechanism unlocks, so that the elevator 8 can be demounted from the lifting hook 210.

In a preferred example, the locking mechanism mainly comprises a locking block 213, a rack 215, a worm gear 214, and a motor 216. The motor 216 is fixedly connected to the lifting hook 210, and an output shaft thereof is connected with the worm gear 214. The worm gear 214 is engaged with the rack 215, so as to drive the rack 215 to extend or retract along a sliding rail on the lifting hook 210. The locking block 213 is fixedly connected with an end of the rack 215 near an inlet of the lifting hook. A groove 212 is disposed on the other side of the lifting hook 210 relative to said inlet, which can be engaged with the locking block 213. When the motor 216 rotates in a forward direction, the worm gear 214 rotates therewith, thereby driving the rack 215 to extend toward the groove 212. When the locking block 213 enters the groove 212, the inlet of the lifting hook 210 is locked up. When it is necessary to unlock, the motor 6 counterrotates, so that the rack 215 drives the locking block 213 to retract back to the side of the lifting hook 210 adjacent to the tip thereof, thereby opening the inlet of the lifting hook 210. Such a locking mechanism can be flexibly controlled. In the meantime, because the rack 215 extends or retract in a relatively small range, the locking mechanism can be locked or unlocked rapidly.

In an example, the tripping out operation of an oil pipe is as follows. FIG. 1 shows an initial stage of the tripping out operation of the oil pipe. The oil pipe 9 is suspended on the elevator 8*b* adjacent to the wellhead 7, and the empty elevator 8*a* is suspended on the lifting hook 210. The rotating arms 22*c* of the rotation mechanism 221 hang down naturally. The movable connecting plate 22*h*, the arms 22*i* for supporting the pick-up/put-down of the elevator, and the drive cam 22*j* of the detent mechanism 222 are all at a lower dead-center position.

First of all, the lifting hook 210 carries the elevator 8*a* and descends. In the meantime, the driving motor or hydraulic motor 22*a* of the rotation mechanism 221 drives the rotating arms 22*c* to rotate counterclockwisely through the rotation shaft 22*b*. When the elevator 8*a* on the lifting hook 210 descends to the upper connection point A, the positions of the connecting blocks 22*e* of the rotating arms 22*c* overlap with the positions of the pick-up/put-down projections 83 of the elevator 8*a*. At this time, the locking mechanism of the lifting hook 210 drives the worm gear 214 through the motor 216, thereby driving the rack 215 to retract, so that the locking mechanism can be remotely unlocked and the elevator 8*a* can be picked up by the rotating arms 22*c*. Then, the rotating arms 22*c* carry the elevator and rotate clockwisely, and the lifting hook 210 continues to descend along the axis of the wellhead 7. The movable connecting plate 22*h* and the arms 22*i* for supporting the pick-up/put-down of the elevator rotate counterclockwisely under the action of the drive cam 22*j*. In this case, the lifting hook 210, the rotating arms 22*c*, and the arms 22*i* move simultaneously in different spatial regions. The lifting hook 210 continues to descend to a preset location H which is a little lower than the lower connection point B. The arms 22*i* for supporting the pick-up/put-down of the elevator rotate and lift the n-shaped ring 81 of the elevator 8*b* to the preset location H. The rotating arms 22*c* carry the elevator 8*a* and rotate clockwisely to any position that does not exceed position E. Further, the lifting hook 210 lifts and the n-shaped ring 81 of the elevator 8*b* is connected to the lifting hook 210. The lifting hook 210 remotely controls the locking mechanism to lock up the n-shaped ring 81, and carries the elevator 8*b* to which an oil pipe 9 is connected and continues to ascend. At this time, the elevator 8*b* is locked to the lifting hook 210 and ascends with the oil pipe 9. While the lifting hook 210 is lifting the oil pipe 9, a driving mechanism, such as a motor or electrical machine, drives the drive cam 22*j* to rotate back to the lower dead-center position. In this case, the rotating arms 22*c* carry the elevator 8*a* to move to a preset location F without being blocked by the arms 22*i* for supporting the pick-up/put-down of the elevator. Next, the motor or electrical machine drives the arms 22*i* to rotate counterclockwisely to a position G, where elevator 8*a* rests on the movable connecting plate 22*h* and the arms 22*i* take over the n-shaped ring 81 of elevator 8*a*. The rotating arms 22*c* move back to the initial positions thereof to stand by. When a coupling of a next oil pipe 9 lifted by the lifting hook 210 from the wellhead 7 exceeds the height of elevator 8*a*, the lifting hook 210 stops moving. Elevator 8*a* moves to the wellhead 7 under the actions of the arms 22*i* for supporting the pick-up/put-down of the elevator and the moving blocks 22*g*. When the valve of the elevator 8*a* is remotely closed, the next oil pipe 9 is connected to the elevator 8*a*. The elevator 8*a* suspends the next oil pipe 9 and breaks out the oil pipe joint from the oil pipe. When the oil pipe 9 is separated from a next oil pipe to be tripped out, the lifting hook 210 carries the oil pipe 9 and moves upwards to the ground, and then releases the oil pipe 9. Then, the lifting hook 210 brings the empty elevator back to an initial stage of the tripping operation. While the lifting hook 210 is hoisting the broken-out oil pipe, the arms 22*i* for supporting the pick-up/put-down of the elevator also return to their initial positions. The repetition of the above operations enables continuous, automatic tripping out operations of the oil pipe.

In a preferred example, the tripping in operation of an oil pipe is as follows. FIG. 2 shows an initial stage of the tripping in operation of an oil pipe. An elevator 8*b* is disposed on a wellhead equipment of a wellhead 7, which is used for suspending an oil pipe 9 in the oil well. An elevator 8*a* is suspended on a lifting hook 210. Axes of rotating arms 22*c* of the rotation mechanism 221 are parallel to an axis of the wellhead 7. A movable connecting plate 22*h* of arms 22*i* for supporting the pick-up/put-down of the elevator is disposed at a lower dead-center position. A hydraulic cylinder 22*k* makes a moving block 22*g* to stay at a position K to stand by.

First, the elevator 8*a* which is suspended on the lifting hook 210 descends and is connected with an oil pipe on a well site. After a valve of the elevator 8*a* is remotely closed, the lifting hook 210 ascends and lifts the elevator 8*a* to which the oil pipe 9 is connected. After the body of the oil pipe 9 is above the height of an oil pipe coupling at the wellhead, the elevator 8*a* descends and connects the oil pipe 9 with the oil pipe at the wellhead. The lifting hook 210 further lifts the oil pipe connected to the elevator 8*a* for a certain distance. And then, the valve of the elevator 8*b* is remotely opened. Subsequently, the lifting hook 210, the hydraulic cylinder 22*k*, the motor or electrical machine, an elevator transfer hydraulic motor 41 operate simultaneously respectively in different spatial regions. The hydraulic cylinder 22*k* drives the moving block 22*g* to a position L, push the elevator 8*b* away from the axis of the wellhead 7, and return to position K for stand-by. After the hydraulic cylinder 22*k* pushes the elevator 8*b* away from the wellhead 7, the lifting hook 210 carries the elevator 8*a* to which the oil pipe 9 is connected to descend. The rotating arms 22*c* rotate counterclockwisely to a position G, and connect with the pick-up/put-down projections 83 located at a position F. The movable connecting plate 22*h* and the arms 22*i* for supporting the pick-up/put-down of the elevator rotate clockwisely to a lower dead-center position. Rotating arms 22*c* rotate counterclockwisely, thereby taking the elevator 8*b* therewith. The lifting hook 210 carries the elevator 8*a* to which an oil pipe is connected and descends to the wellhead 7. The movable connecting plate 22*h* and the arms 22*i* rotate counterclockwisely. When the lifting hook 210 descends with the elevator 8*a* to the preset location H below the lower connection point B, the arms 22*i* also move to the position H. At this time, the elevator 8*a* is located on a platform at the wellhead 7, and suspends the oil pipe in the well. The locking mechanism of the lifting hook 210 is remotely unlocked. After further descending for a small distance, the lifting hook 210 is separated from the elevator 8*a*. An n-shaped ring 81 of the elevator 8*a* is driven by the arms 22*i* to rotate clockwisely to the lower dead-center position for stand-by. In the meantime, the lifting hook 210 ascends to the upper connection point A, where it takes over the elevator 8*b* which is carried by the rotating arms 22*c*. After the elevator 8*b* is connected to the lifting hook 210, the locking mechanism of the lifting hook 210 is remotely locked. The lifting hook 210 hoists the elevator 8*b* and returns to the initial position for a tripping in operation of the oil pipe, so as to be ready for connecting to a next oil pipe. While the lifting hook 210 is hoisting the elevator 8*b*, the rotating arms 22*c* and the arms 22*i* also rotate clockwisely back to their initial positions for stand-by. In this case, the system restores its initial state for a tripping in operation of the oil pipe. The repetition of the above operations enables continuous, automatic tripping in operations of the oil pipe.

While the present disclosure has been described with reference to the embodiments, various modifications can be made thereto without departing from the scope and spirit of the present disclosure and components in the present disclosure could be substituted with equivalents. In particular, as long as there is no structural conflict, all the technical features mentioned in all the embodiments may be combined together in any manner. The present disclosure is not limited to the specific embodiments disclosed in the description, but rather includes all the technical solutions falling into the scope of the claims.

The invention claimed is:

1. An apparatus for tripping oil pipe, comprising an elevator transfer device for transferring an elevator connectable to an oil pipe, the elevator transfer device being configured for enabling continuous, automatic tripping operations of the oil pipe, wherein the elevator transfer device comprises a lifting assembly for lifting and releasing the oil pipe engaged with the elevator, and an elevator transport assembly for transferring the elevator at a wellhead, or on the lifting assembly, or both, wherein an upper connection point and a lower connection point are respectively located at two intersection points between a trajectory of the elevator transport assembly and a trajectory of the lifting assembly, and the elevator transport assembly and the lifting assembly are configured to operate simultaneously, wherein the lifting assembly and the elevator transport assembly are configured to perform a direct handover of the elevator at the upper connection point, and one of the lifting assembly and the elevator transport assembly is configured to pick up the elevator while the other is configured to release the elevator at a preset location below the lower connection point, and the elevator transport assembly is configured to transfer the elevator as the elevator is empty.

2. The apparatus for tripping oil pipe according to claim 1, wherein the elevator transport assembly comprises a rotation mechanism for carrying the elevator for rotation along a circular path, and a detent mechanism for loading and unloading as well as moving the elevator adjacent to the wellhead, and in a process of tripping the oil pipe, an angle of rotation of the rotation mechanism is larger than 180° and smaller than 360°.

3. The apparatus for tripping oil pipe according to claim 2, wherein when tripping out the oil pipe, the lifting assembly carries the elevator as the elevator is empty and descends to the upper connection point, and the rotation mechanism takes down the elevator from the lifting assembly as the elevator is empty and rotates with the elevator, the lifting assembly continues to descend to the preset location below the lower connection point, where the elevator carrying the oil pipe is mounted to the lifting assembly using the detent mechanism, and then the lifting assembly ascends with the oil pipe, and the rotation mechanism carries the elevator as the elevator is empty and rotates to a preset location thereof adjacent to the wellhead and releases the elevator using the detent mechanism, the elevator being continued to move to the wellhead and connect to an oil pipe to be tripped out using the detent mechanism as the elevator is empty.

4. The apparatus for tripping oil pipe according to claim 2, wherein, when tripping in the oil pipe, the elevator is released at the wellhead moved using the detent mechanism as the elevator is empty, engages the rotation mechanism, and rotates towards the upper connection point using the rotation mechanism, when the rotation mechanism carries the elevator to rotate towards the upper connection point, the lifting assembly carries the elevator connected with the oil pipe to descend to the wellhead and releases the elevator under the assistance of the detent mechanism, and then ascends to the upper connection point, and the rotation mechanism hands the elevator over to the lifting assembly at the upper connection point as the elevator is empty, and the lifting assembly carries the elevator as the elevator is empty and continues to ascend to a target location.

5. The apparatus for tripping oil pipe according to claim 2, wherein the elevator comprises an n-shaped ring for connecting with a lifting hook of the lifting assembly, and an oil pipe connecting base disposed at an opening end of the n-shaped ring, wherein the n-shaped ring is in a detachable connection with the oil pipe connecting base, and each of two side walls of the n-shaped ring are provided with a projection that is configured to engage the elevator transport assembly.

6. The apparatus for tripping oil pipe according to claim 5, wherein the detent mechanism comprises:

a fixed plate disposed at the wellhead for supporting the elevator, a moving block flexibly arranged on the fixed plate, which enables the elevator to move back and forth adjacent to the wellhead, a movable connecting plate hinged with one end of the fixed plate and is configured to move downwards, an arm for supporting a vertical movement of the elevator, which is connected with the movable connecting plate, and a driver member for driving the movable connecting plate and the arm for supporting the vertical movement of the elevator.

7. The apparatus for tripping oil pipe according to claim 6, wherein the moving block is driven by a hydraulic cylinder and is disposed at one side of an axis of the wellhead opposite to the rotation mechanism, and the arm and the rotation mechanism are located at the other side of the axis of the wellhead.

8. The apparatus for tripping oil pipe according to claim 5, wherein the rotation mechanism comprises: a rotation supporting structure, a rotation shaft rotatably connected to the rotation supporting structure, and a rotating arm connected to the elevator, which is fixedly connected to the rotation shaft and rotates with the rotation shaft.

9. The apparatus for tripping oil pipe according to claim 8, further comprising two rotating arms symmetrically arranged relative to the axis of the wellhead, an inner side of each of the rotating arms being provided with a connecting block engaged with the projection on the n-shaped ring of the elevator, wherein the two connecting blocks engage and interlock with each other during the transfer of the elevator, and unlock from each other when the elevator is delivered to the target location.

10. The apparatus for tripping oil pipe according to claim 8, wherein an angle of rotation of the rotation shaft is in a range of 270° to 345°.

11. The apparatus for tripping oil pipe according to claim 1, wherein the lifting assembly comprises a lifting hook connected to the elevator and a locking mechanism on the lifting hook for locking the elevator, wherein the locking mechanism locks up during the transfer of the elevator, and unlocks when the elevator is delivered to a target location.

12. The apparatus for tripping oil pipe according to claim 11, wherein the locking mechanism comprises:

a locking block engaged and interlocked with a groove arranged on a different side relative to an inlet of the lifting hook, which is disposed at a tip of the lifting hook adjacent to the inlet the lifting hook, a rack disposed on a sliding rail on the lifting hook and fixedly connected with the locking block, a worm gear connected to the lifting hook and engaged with the rack, and a motor connected to the lifting hook for driving the worm gear.

13. A system for automatic well workover, comprising:

the apparatus for tripping oil pipe according to claim 1;

a make-up/break-out device for connecting an oil pipe joint to the oil pipe and for demounting the oil pipe joint on the oil pipe, an oil pipe centralizer device for centralizing the oil pipe, an oil pipe transport and hoist device for transporting and hoisting the oil pipe, and a controller electrically connected to the make-up/break-out device, the oil pipe centralizer device, the apparatus for tripping oil pipe, and the oil pipe transport and hoist device.

* * * * *